US011155402B2

(12) United States Patent
Caldas

(10) Patent No.: US 11,155,402 B2
(45) Date of Patent: Oct. 26, 2021

(54) CARTRIDGE TUBE

(71) Applicant: Lerman Container Corporation, Jupiter, FL (US)

(72) Inventor: Daniel Caldas, Jupiter, FL (US)

(73) Assignee: LERMAN CONTAINER CORPORATION, Jupiter, FL (US)

( * ) Notice: Subject to any disclaimer, the term of this patent is extended or adjusted under 35 U.S.C. 154(b) by 0 days.

(21) Appl. No.: 16/749,797

(22) Filed: Jan. 22, 2020

(65) Prior Publication Data

US 2020/0231369 A1 Jul. 23, 2020

Related U.S. Application Data

(60) Provisional application No. 62/795,333, filed on Jan. 22, 2019.

(51) Int. Cl.
*B65D 85/08* (2006.01)
*B65D 55/02* (2006.01)

(52) U.S. Cl.
CPC ..... *B65D 85/08* (2013.01); *B65D 55/02* (2013.01)

(58) Field of Classification Search
CPC ..... B65D 85/08; B65D 55/02; B65D 85/10
USPC .... 206/242, 446, 217, 457, 569; 215/379, 6; 356/244, 246; 422/50, 549
See application file for complete search history.

(56) References Cited

U.S. PATENT DOCUMENTS

D142,842 S 2/1945 Daze
D167,230 S 4/1952 Rehfeld
3,481,712 A * 12/1969 Bernstein ..... B04B 9/10 422/548
3,627,432 A * 12/1971 Bergmann ..... G01N 21/03 356/246
D223,879 S 6/1972 Chernack
D224,760 S 9/1972 Chernack
4,021,124 A * 5/1977 Sarstedt ..... G01N 21/03 356/246
4,140,489 A * 2/1979 Lee ..... B01L 3/5082 215/6
D254,316 S 2/1980 Anderka
4,393,974 A * 7/1983 Levesque ..... A45C 11/00 206/37

(Continued)

FOREIGN PATENT DOCUMENTS

CN 104382237 3/2015
CN 204191593 3/2015

OTHER PUBLICATIONS

International Search Report and Written Opinion, U.S Patent and Trademark Office, Application No. PCT/US2020/014598, dated Apr. 1, 2020.

(Continued)

*Primary Examiner* — Rafael A Ortiz
(74) *Attorney, Agent, or Firm* — Gottlieb, Rackman & Reisman, PC

(57) ABSTRACT

A cartridge tube configured to secure and display a product therein that includes a first tube and a second tube that extends from the first tube and an outer diameter that is less than an inner diameter of the first tube with an inner surface of the first tube transitioning to an inner surface of the second tube at an inclined portion of the inner surface of the first tube to aid in positioning a product within the second tube.

6 Claims, 14 Drawing Sheets

(56) References Cited

U.S. PATENT DOCUMENTS

| | | | | |
|---|---|---|---|---|
| 5,075,905 | A * | 12/1991 | Rutherford | E03C 1/284 137/247.51 |
| 5,382,409 | A * | 1/1995 | Baxter | B01L 3/5082 220/732 |
| 6,065,609 | A * | 5/2000 | Lake | A47J 31/02 206/0.5 |
| D547,822 | S | 7/2007 | Kennedy et al. | |
| D547,825 | S | 7/2007 | Kennedy et al. | |
| 7,481,928 | B2 | 1/2009 | Fritze | |
| D590,991 | S | 4/2009 | Hon | |
| D655,036 | S | 2/2012 | Zhou | |
| D666,355 | S | 8/2012 | Alelov | |
| D683,897 | S | 6/2013 | Liu | |
| D684,311 | S | 6/2013 | Liu | |
| D720,499 | S | 12/2014 | Alima | |
| D722,956 | S | 2/2015 | Alima | |
| D739,598 | S | 9/2015 | Lavanchy et al. | |
| D750,834 | S | 3/2016 | Wei | |
| D752,278 | S | 3/2016 | Verleur et al. | |
| D753,873 | S | 4/2016 | Schuessler | |
| D756,031 | S | 5/2016 | Wu | |
| D762,812 | S | 8/2016 | Branscomb et al. | |
| D764,702 | S | 8/2016 | Di Bari | |
| D770,087 | S | 10/2016 | Di Bari | |
| D778,492 | S | 2/2017 | Liu | |
| D779,722 | S | 2/2017 | Volodarsky | |
| D787,114 | S | 5/2017 | Scott | |
| D792,021 | S | 7/2017 | Beer et al. | |
| 9,700,691 | B2 | 7/2017 | Watanabe et al. | |
| D797,369 | S | 9/2017 | Yamada et al. | |
| D803,475 | S | 11/2017 | Scheiber | |
| D805,248 | S | 12/2017 | Chen et al. | |
| D806,942 | S | 1/2018 | Qiu | |
| D808,580 | S | 1/2018 | Kwitel et al. | |
| D812,807 | S | 3/2018 | Thuery | |
| D813,445 | S | 3/2018 | Scott | |
| D814,102 | S | 3/2018 | Lehoux | |
| D815,342 | S | 4/2018 | Sutton | |
| D816,266 | S | 4/2018 | Thuery | |
| D821,028 | S | 6/2018 | Tucker et al. | |
| D825,835 | S | 8/2018 | Verleur et al. | |
| D825,838 | S | 8/2018 | Abroff et al. | |
| D832,503 | S | 10/2018 | Blanding | |
| D834,743 | S | 11/2018 | Tucker et al. | |
| D836,833 | S | 12/2018 | Simon | |
| D843,648 | S | 3/2019 | Santos | |
| D844,222 | S | 3/2019 | Yamada et al. | |
| D850,595 | S | 6/2019 | Li | |
| D862,795 | S | 10/2019 | Caldas | |
| 2006/0261000 | A1 | 11/2006 | Bassett et al. | |
| 2011/0290244 | A1 | 12/2011 | Schennum | |
| 2013/0192618 | A1 | 8/2013 | Li et al. | |
| 2015/0342258 | A1 | 12/2015 | Chen | |
| 2016/0073692 | A1 | 3/2016 | Alarcon et al. | |
| 2016/0073694 | A1 | 3/2016 | Liu | |
| 2016/0135502 | A1 | 5/2016 | Wang et al. | |
| 2016/0150821 | A1 | 6/2016 | Liu | |
| 2016/0183596 | A1 | 6/2016 | Rado | |
| 2016/0302487 | A1 | 10/2016 | Chen | |
| 2017/0196266 | A1 | 7/2017 | Chen | |
| 2017/0202266 | A1 | 7/2017 | Sur | |
| 2017/0294804 | A1 | 10/2017 | Sur | |
| 2017/0295845 | A1 | 10/2017 | Bajpai et al. | |
| 2018/0169355 | A1 | 6/2018 | Reevell | |
| 2018/0255835 | A1 | 9/2018 | Crowe et al. | |
| 2018/0271149 | A1 | 9/2018 | Holtz et al. | |
| 2019/0008207 | A1 | 1/2019 | Crowe | |
| 2019/0090551 | A1 | 3/2019 | Hon | |

OTHER PUBLICATIONS

Marijuanapackaging.com, Child resistant vape cartridge container clear 20mm, Dec. 17, 2016, https://marijuanapackaging.com/products/child-resistant-vape-cartridge-container-clear-20mm-1.

Marijuanapackaging.com, Child resistant vape cartridge container 16mm, Dec. 17, 2016, https://marijuanapackaging.com/products/vape-container-16mm-cr-2-500-count.

Berry Global Inc., 20 mm Purse Pak Vial, Jan. 20, 2020, https://catalog.berryglobal.com/products/closure/closure-specialty/cy20splyypv.

Berry Global Inc., 16 mm Purse Pak Vial, Jan. 20, 2020, https://catalog.berryglobal.com/products/closure/closure-specialty/cy16splyypv.

Pollen Gear, Greenlane Holdings LLC, Five10 Tube, Jan. 20, 2020, https://pollengear.com/five10-tubes.

* cited by examiner

CARTRIDGE TUBE

CROSS-REFERENCE TO RELATED APPLICATION

This patent application claims benefit to U.S. Provisional Patent Application No. 62/795,333, filed Jan. 22, 2019, which is hereby incorporated by reference in its entirety as part of the present disclosure.

BACKGROUND OF THE INVENTION

Due to various laws, regulations and best practices, electronic cigarette e-liquid cartridges, syringes, and other primary packing components that are not able to be made child resistant are packaged within child resistant packaging. Frequently, this packaging is a tube with a one or two piece child resistant closure. Due to size restrictions of closures and/or labeling requirements, tubes used to house such products are significantly wider than the primary packing inserted into them, which has many negative side effects. For example, the primary packaging can be damaged by coming into contact with the outer packaging and, for display purposes, the primary packaging and in turn product may be angled within the outer packaging resulting in an aesthetically unpleasing display.

SUMMARY OF THE INVENTION

The present disclosure is directed to a cartridge tube that is configured to hold a product upright in a channel therein thereby reducing impact to the product from the tube walls during transportation and orienting the product for display.

The tube includes a first tube and a second tube. The first tube is configured such that an outer edge of the first tube is symmetrical with an outer edge of a closure that will be attached thereto. The first tube includes a funnel or sloped inner portion that is configured to guide a product in to the second tube. The angle of the funnel is steep enough to guide a cartridge into the second tube, but not so steep that the angle lessens the structural rigidity of the tube. The length of the first tube is designed to accommodate most cartridges on the market today, but not so tall that shorter cartridges will be damaged in transport by escaping the second tube. A channel gap at the distal end of the second tube between the outer wall and end wall of the second tube is designed to speed up the manufacturing process as the air gap allows for reduced cooling times. The diameter of the second tube is large enough to accommodate cartridges, but not allow for excess movement therein. The length of the second tube is configured hold a cartridge in an upright position for display as well as for protection during transport.

DETAILED DESCRIPTION OF EMBODIMENTS OF THE INVENTION

With reference now to the drawings, and in particular to FIGS. 1 through 21, embodiments of a cartridge tube embodying the principles and concepts of the present invention will be described.

FIGS. 1-10 depict various views of a cartridge tube 10 according to an exemplary embodiment of the present disclosure. FIGS. 11-21 depict various views of a cartridge tube 100 according to an exemplary embodiment of the present disclosure. The difference between the tube 10 of FIGS. 1-10 and the tube 100 of FIGS. 11-21 is that the tube 10 is comprised of an opaque material whereas the tube 100 is comprised of a translucent material.

Figure 1:
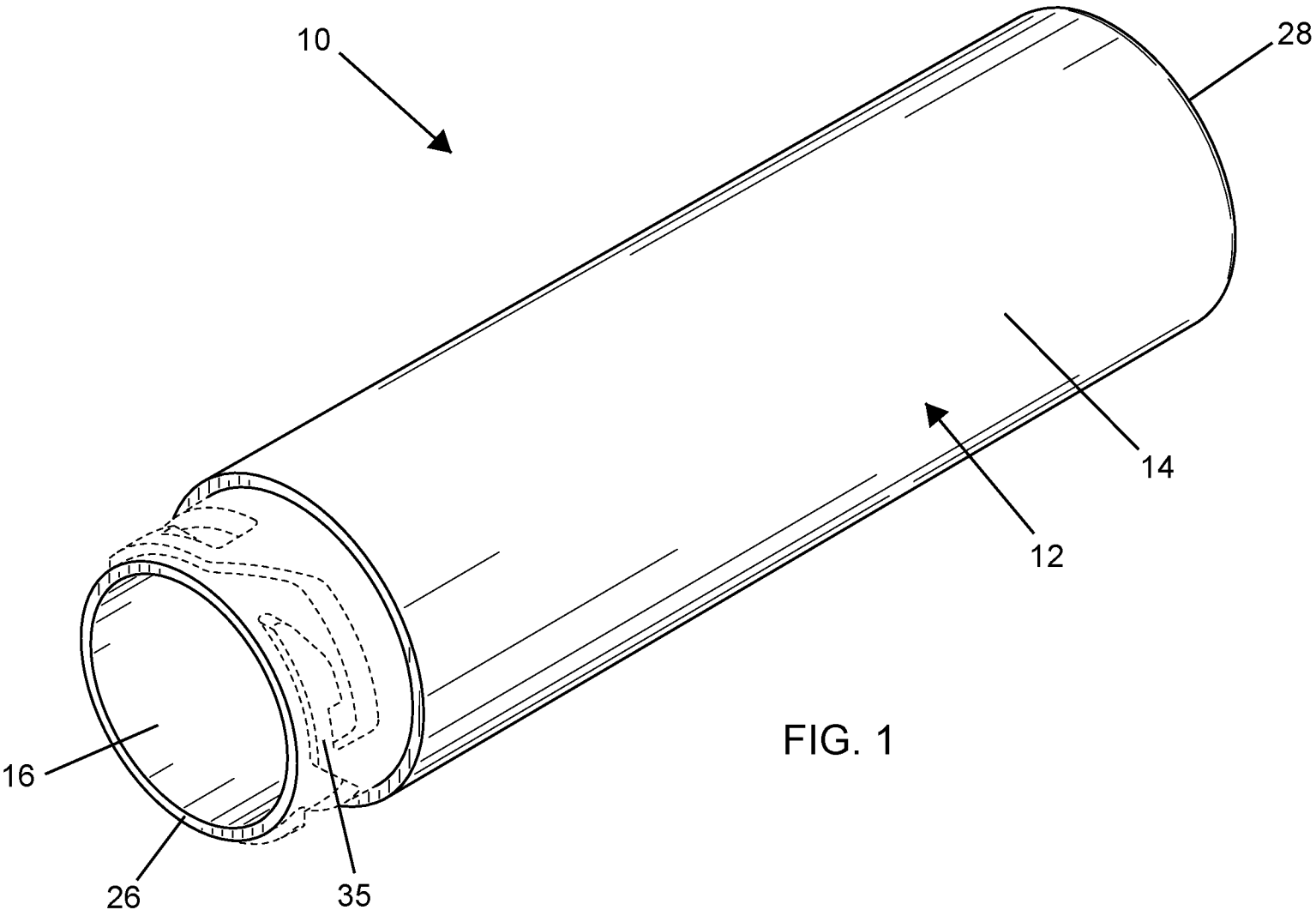
FIG. 1 is a front perspective view of a cartridge tube according to an exemplary embodiment of the present disclosure.
Figure 2:
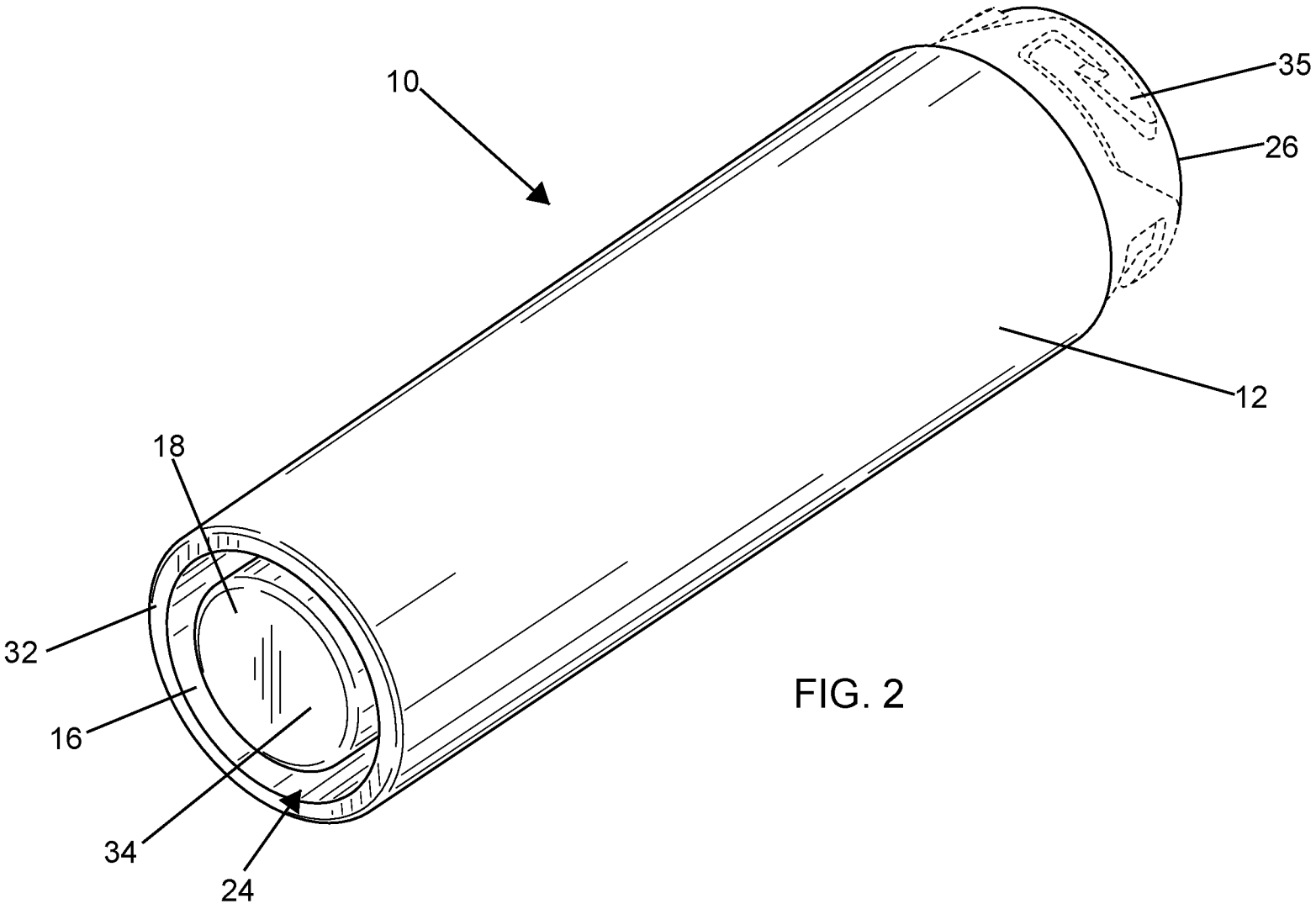
FIG. 2 is a rear perspective view of the cartridge tube according to an exemplary embodiment of the present disclosure.
Figure 3:
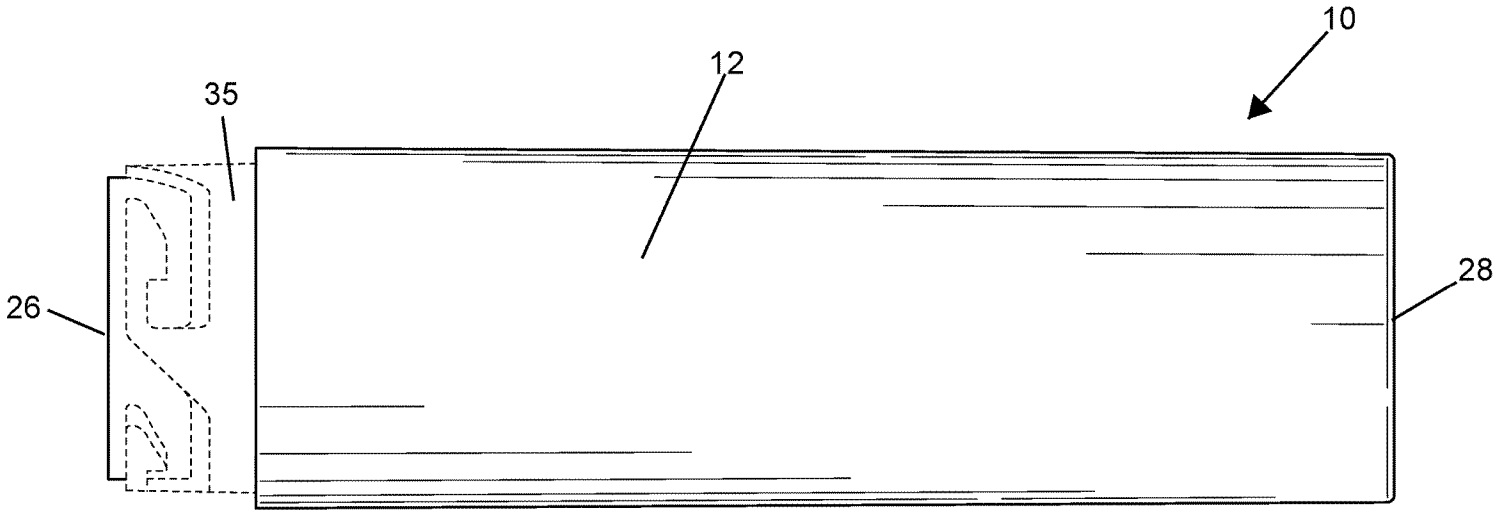
FIGS. 3-7 are side views of the cartridge tube according to an exemplary embodiment of the present disclosure.
Figure 4:
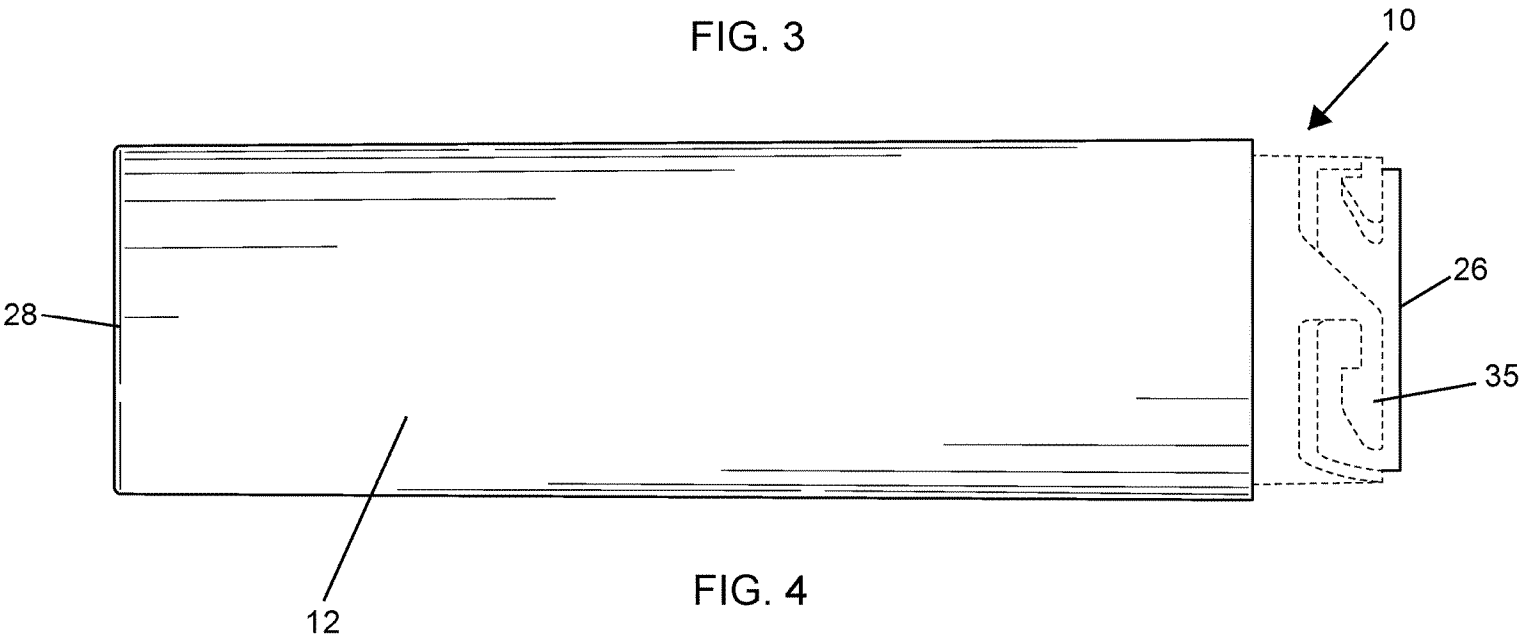
Figure 5:
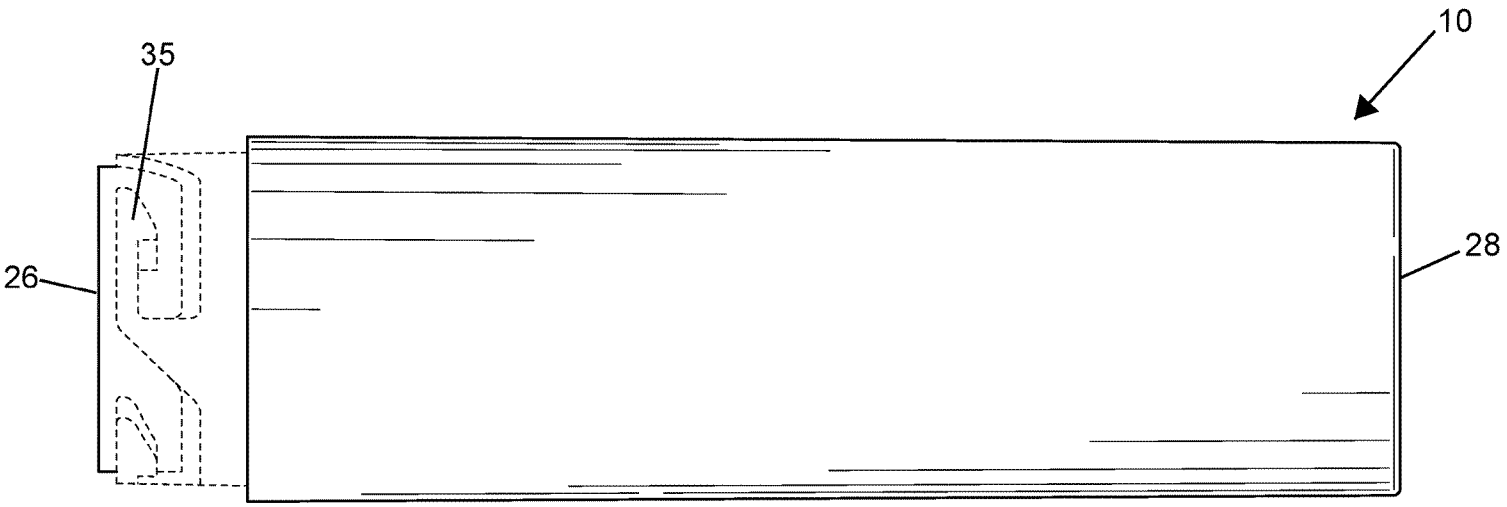
Figure 6:
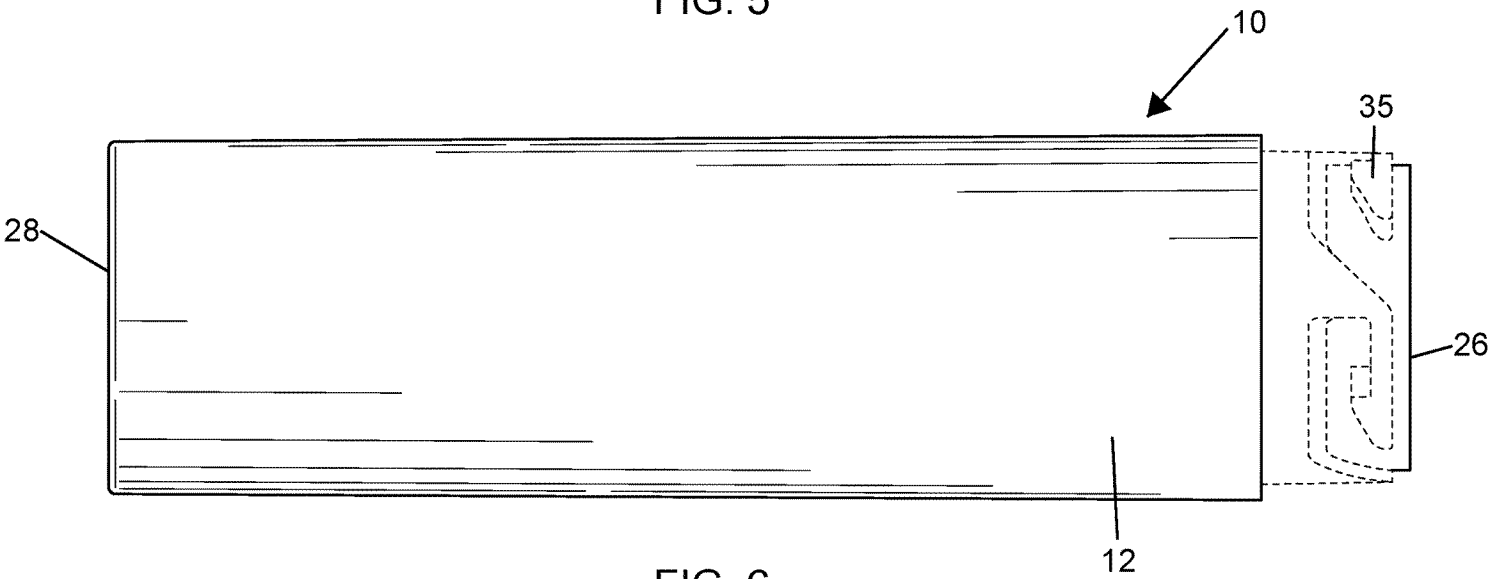
Figure 7:
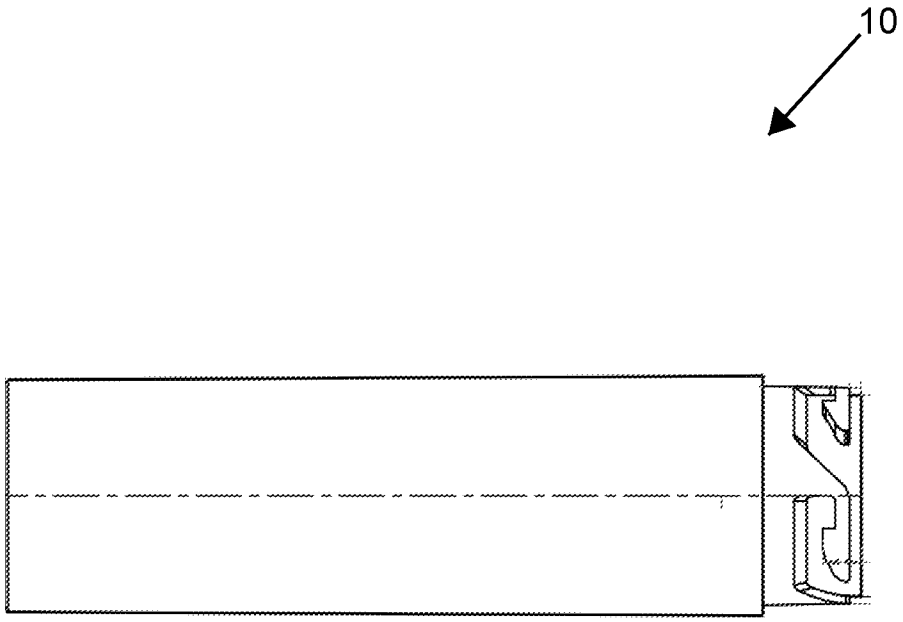
Figure 9:
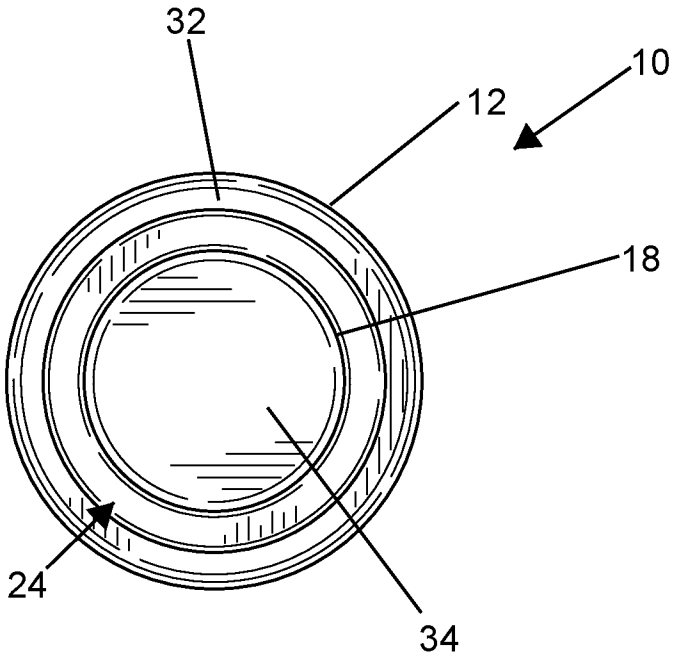
FIG. 9 is a second end view of the cartridge tube according to an exemplary embodiment of the present disclosure.
Figure 8:
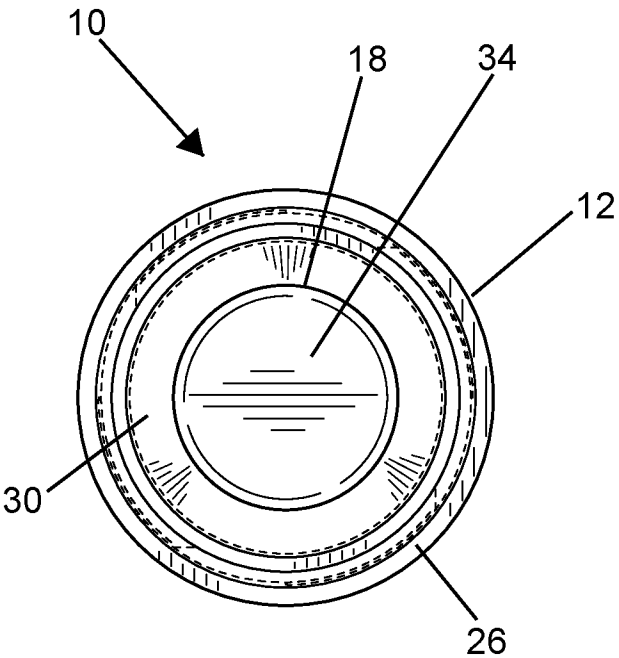
FIG. 8 is a first end view of the cartridge tube according to an exemplary embodiment of the present disclosure.
Figure 10:
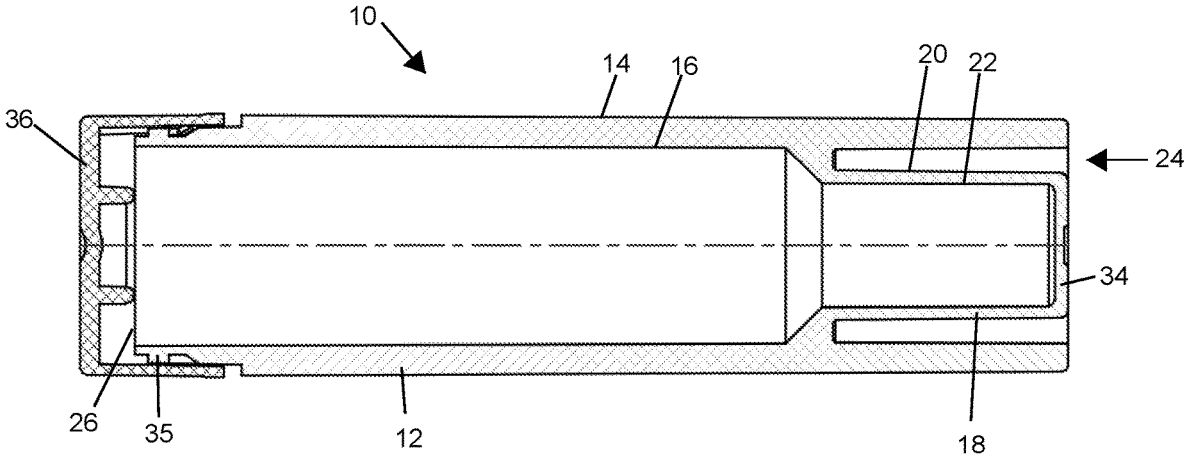
FIG. 10 is a longitudinal cross-sectional view of the cartridge tube with an end cap fixed thereto according to an exemplary embodiment of the present disclosure.
Figure 11:
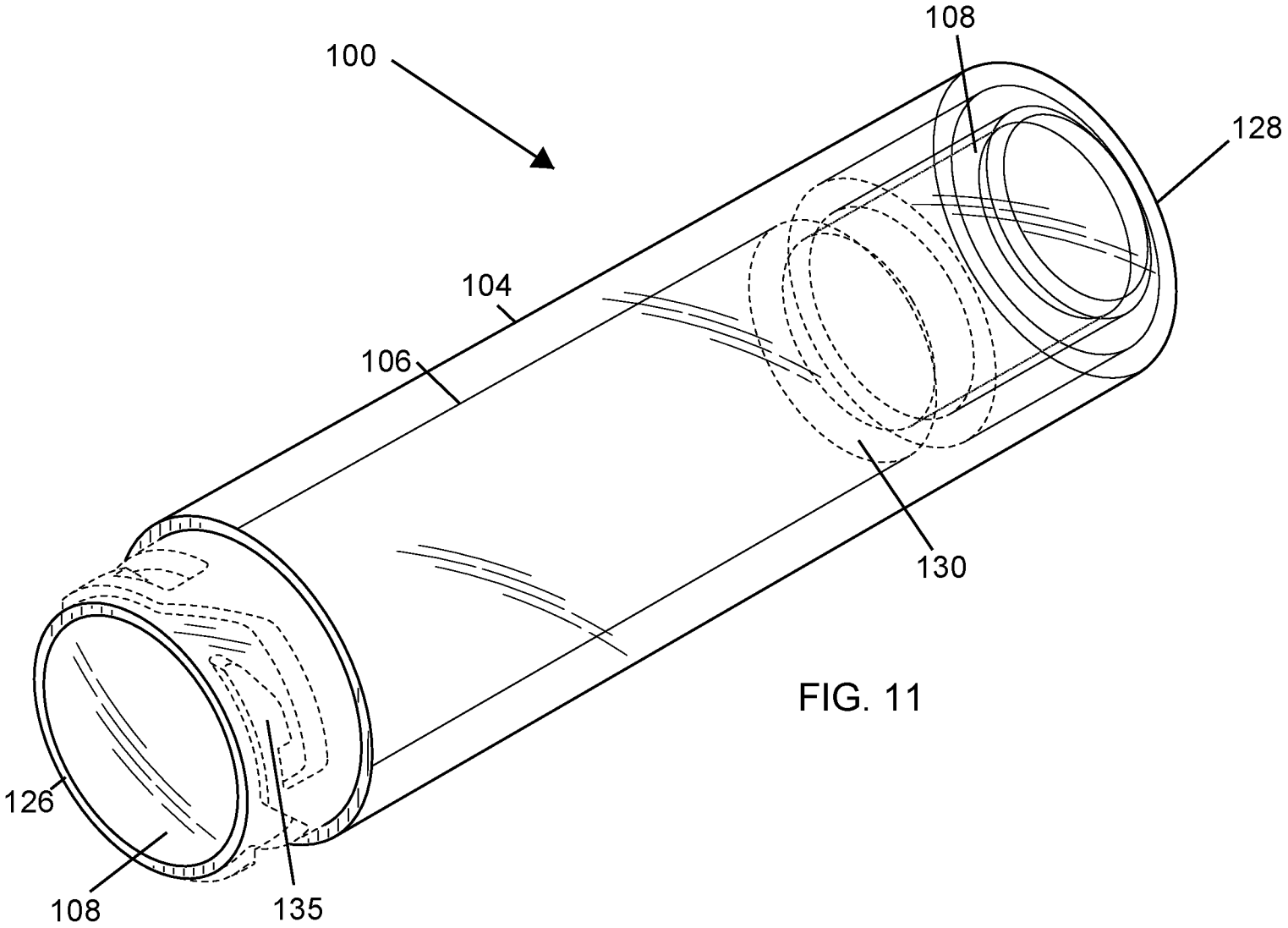
FIG. 11 is a front perspective view of a cartridge tube according to an exemplary embodiment of the present disclosure.
Figure 12:
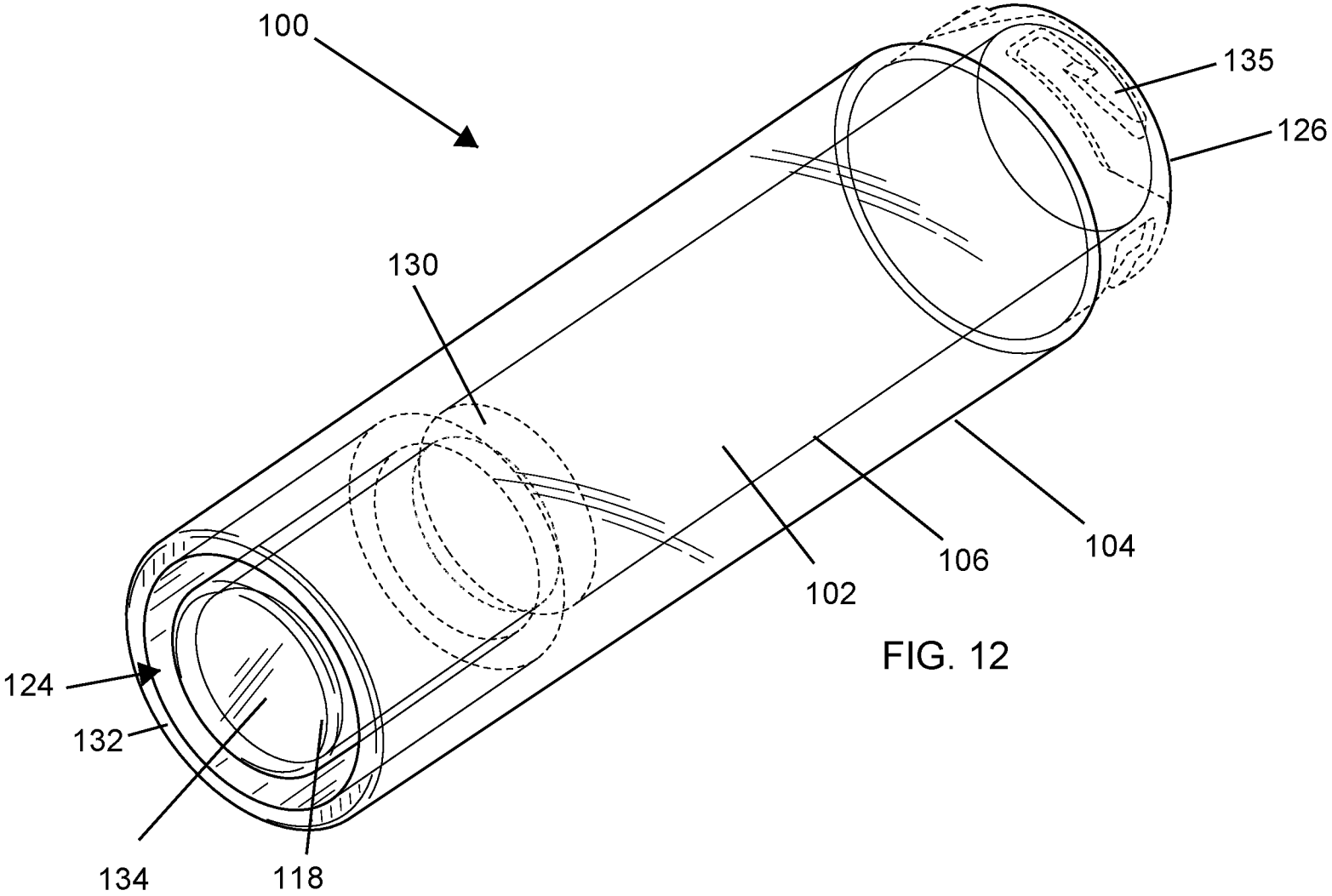
FIG. 12 is a rear perspective view of the cartridge tube according to an exemplary embodiment of the present disclosure.
Figure 13:
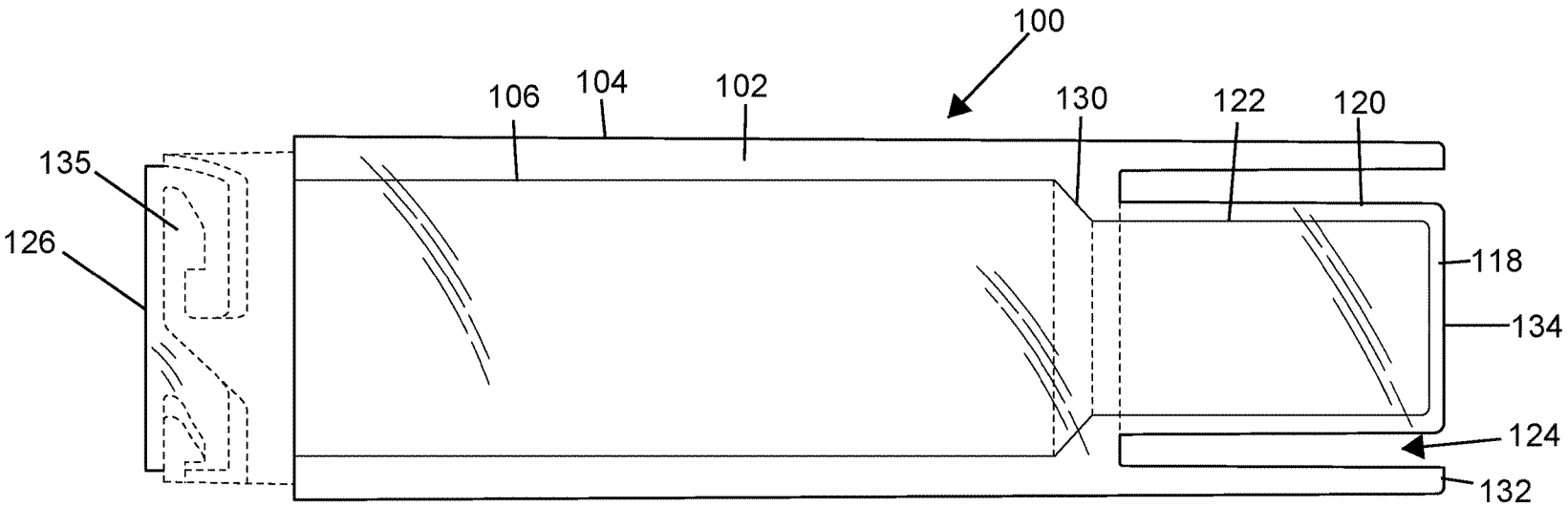
FIGS. 13-16 are side views of the cartridge tube according to an exemplary embodiment of the present disclosure.
Figure 14:
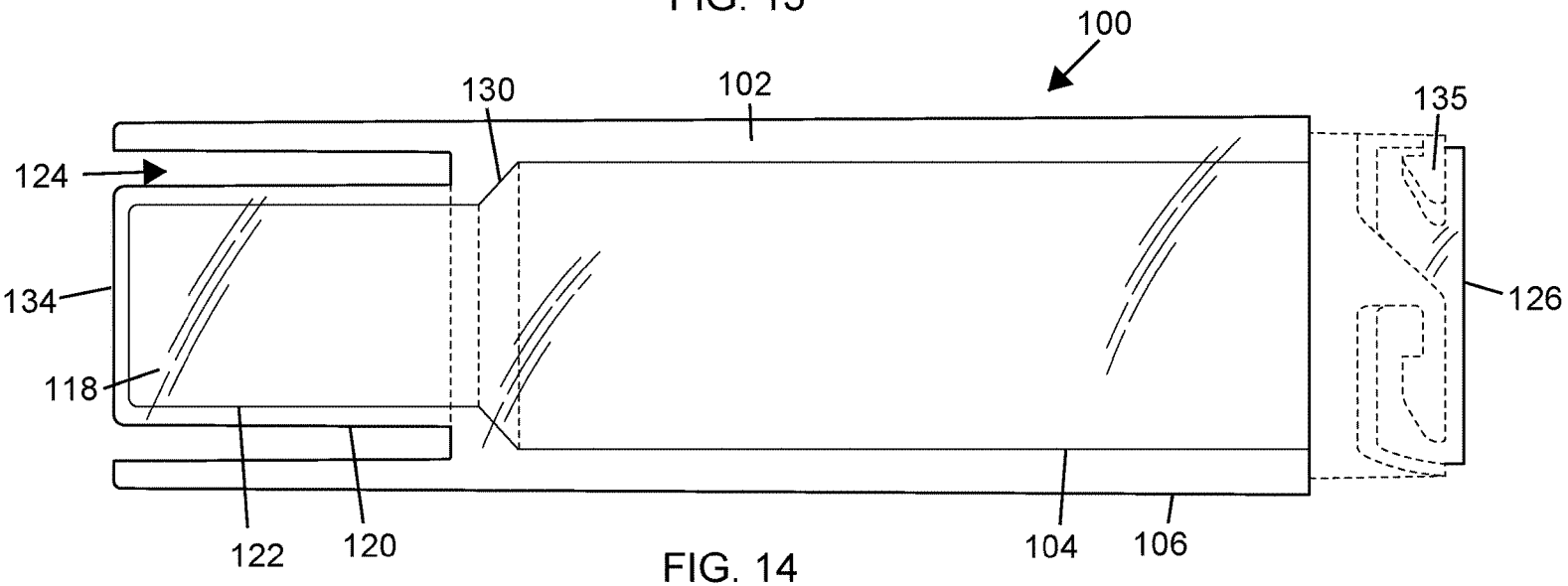
Figure 15:
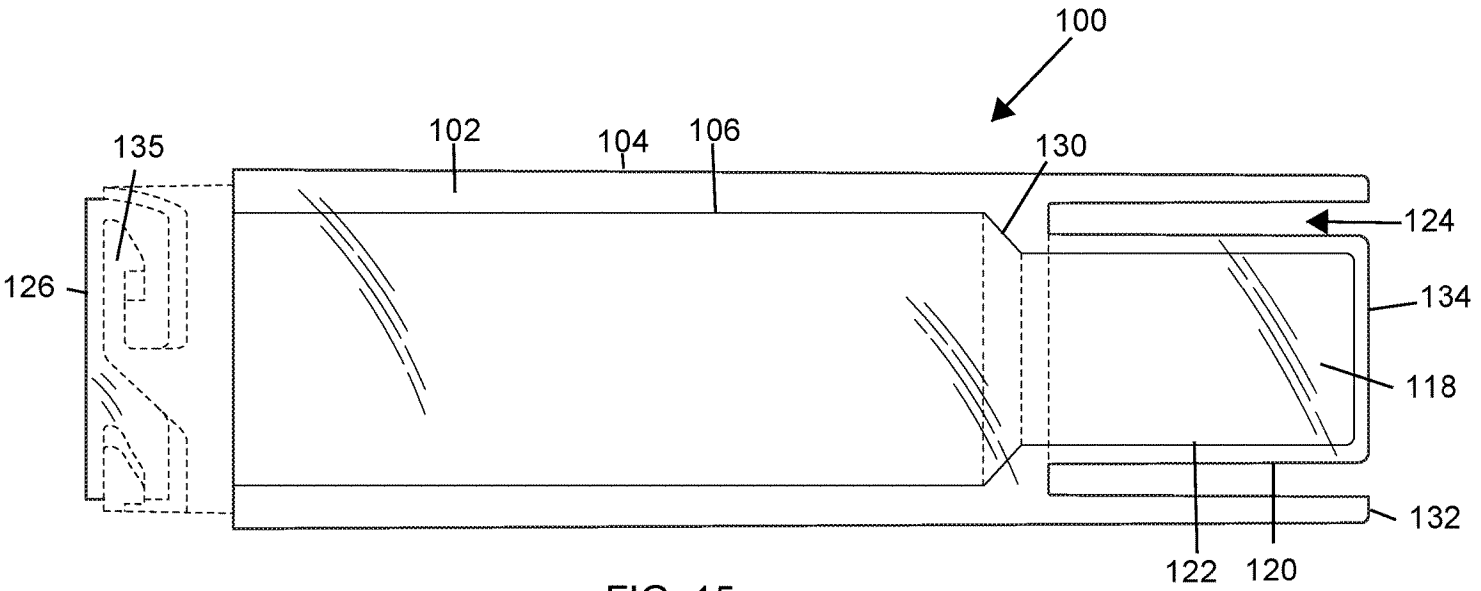
Figure 16:
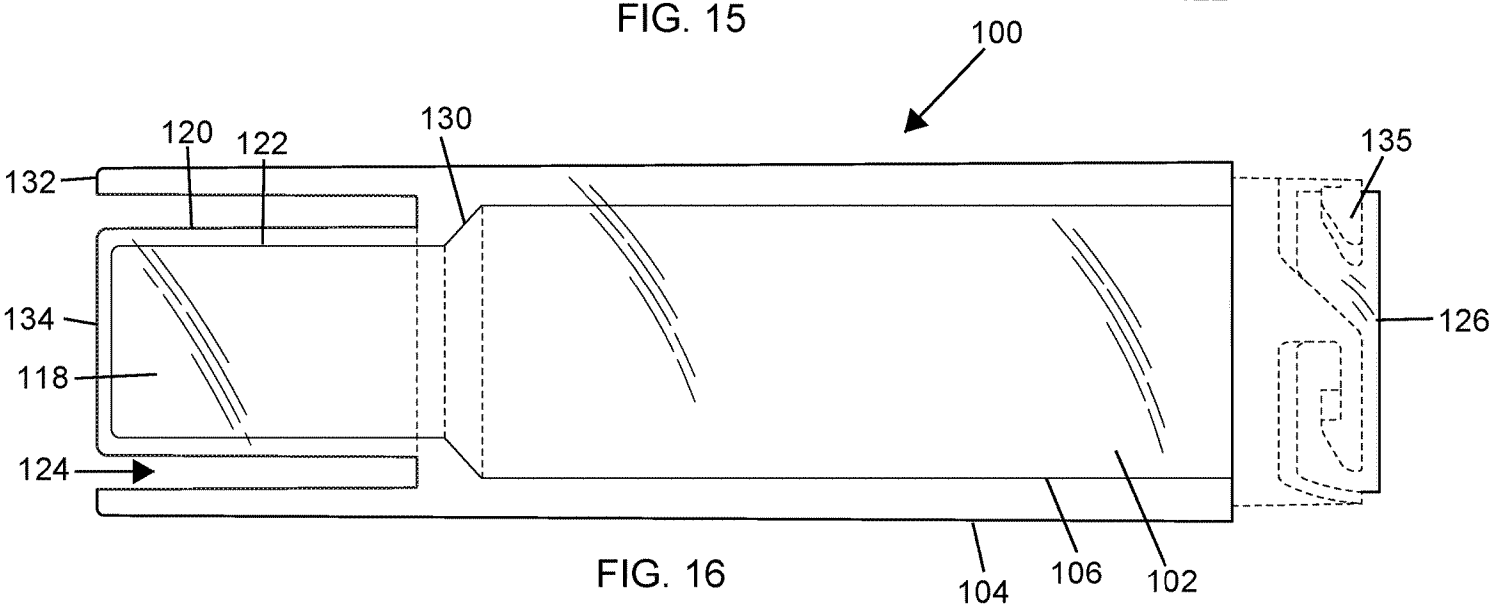
Figure 18:
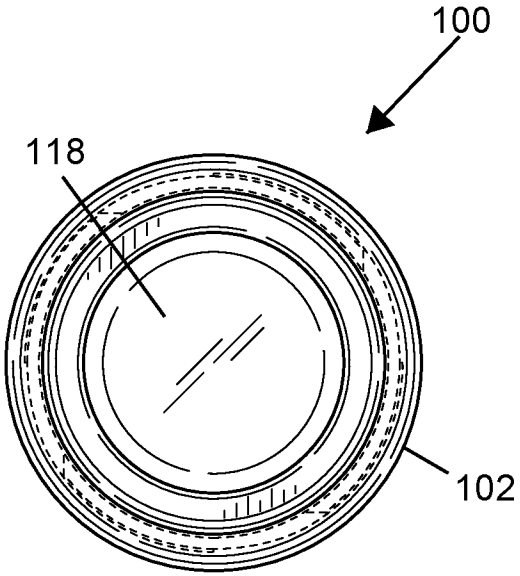
FIG. 18 is a second end view of the cartridge tube according to an exemplary embodiment of the present disclosure.
Figure 17:
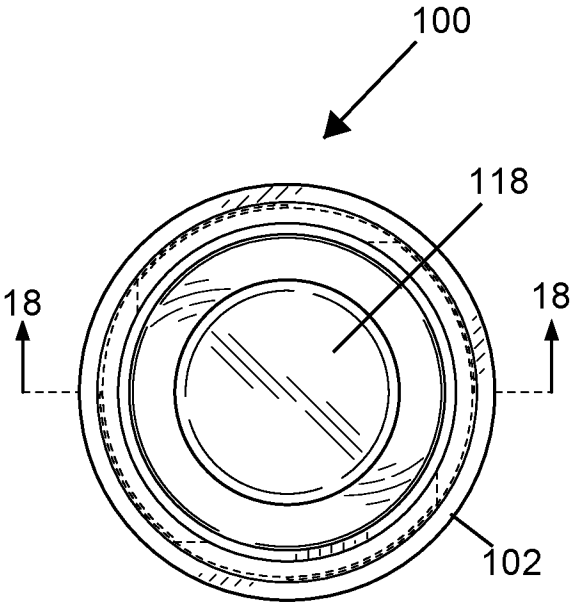
FIG. 17 is a first end view of the cartridge tube according to an exemplary embodiment of the present disclosure.

As shown in FIGS. 1-10, the tube 10 includes a first tube, or first sidewall, 12 that has an outer surface 14 and an inner surface 16 and a second tube, or a second sidewall, 18 that includes an outer surface 20 and an inner surface 22 (see FIG. 10). The second tube 18 is spaced from the first tube 12 such that a gap 24 exists between the first tube 12 and the second tube 18. The inner surface 16 of the first tube 12 extends from a first end 26 of the tube 10 toward a second end 28 of the tube 10 and includes a funnel or angled portion 30 that transitions the inner surface 16 of the first tube 12 to the inner surface 22 of the second tube 18.

The tube 10 is open at the first end 26 to allow for a product to be inserted into the tube 10. The second end 28 of the tube 10 includes a first end wall 32 that delimits the first tube 12 and a second end wall 34 that delimits the second tube 18. To releasably seal the first end 26 of the tube 10, the outer surface of the first tube 12 at the first end 26 includes a plurality of raised locking mechanism 35 (e.g., grooves, channels, etc.) that are mateable with an internal locking mechanism of a cover or cap 36 (see FIG. 10).

The diameter of the first tube 12 is designed such that the outer surface 14 of the first tube 12 is symmetrical with the outer edge of the closure 36 that will be attached thereto. The funnel portion 30 of the first tube 12 is configured to aid in guiding a product in to the inner surface 22 of the second tube 18. The angle of the funnel portion 30 is configured so that it is steep enough to guide a product (e.g., cartridge) into the second tube 18, but not so steep that funnel portion 30 lessens the structural rigidity of the tube 10. For example, as shown in FIG. 10, the funnel portion 30 extends at an obtuse angle with respect to the inner surface 16 of the first tube 12 in cross-sectional view. The length of the second tube 18 is designed to accommodate most known cartridges, but the length of the tube 18 not so long that shorter cartridges would be damaged in transport by escaping the second tube 18. The channel gap 24 at the distal end of the tube 10, between the first sidewall 12 and second sidewall 18 is designed to speed up the manufacturing process as the air gap allows for a reduced cooling time. As shown in FIG. 10, the gap 24 may extend inwardly from the second end 28 along at least a portion of the length of the second tube 18. In addition, the gap 24 may extend all-around the outer surface 20 of the second tube 18 in order to encircle the second tube 18 concentrically. The diameter of the inner tube 18 is set just large enough to accommodate cartridges, but not too large to allow excess rattle. The length of the inner tube 18 is set to hold a cartridge in an upright position for display as well as for protection during transport.

As shown in FIGS. 11-20, the tube 100 includes a first tube, or first sidewall, 102 that has an outer surface 104 and an inner surface 106 and a second tube, or a second sidewall, 108 that includes an outer surface 120 and an inner surface 122. The second tube 108 is spaced from the first tube 102 such that a gap 124 exists between the first tube 102 and the second tube 108. The inner surface 106 of the first tube 102 extends from a first end 126 of the tube 100 toward a second end 128 of the tube 100 and includes a funnel or angled portion 130 that transitions the inner surface 106 of the first tube 102 to the inner surface 122 of the second tube 108.

The tube 100 is open at the first end 126 to allow for a product to be inserted into the tube 100. The second end 128 of the tube 100 includes a first end wall 132 that delimits the first tube 102 and a second end wall 134 that delimits the second tube 108. To releasably seal the first end 126 of the tube 100, the outer surface of the first tube 102 at the first end 126 includes a plurality of raised locking mechanism 135 (e.g., grooves, channels, etc.) that are mateable with an internal locking mechanism of a cover or cap 136 (see FIG. 21).

Figure 19:
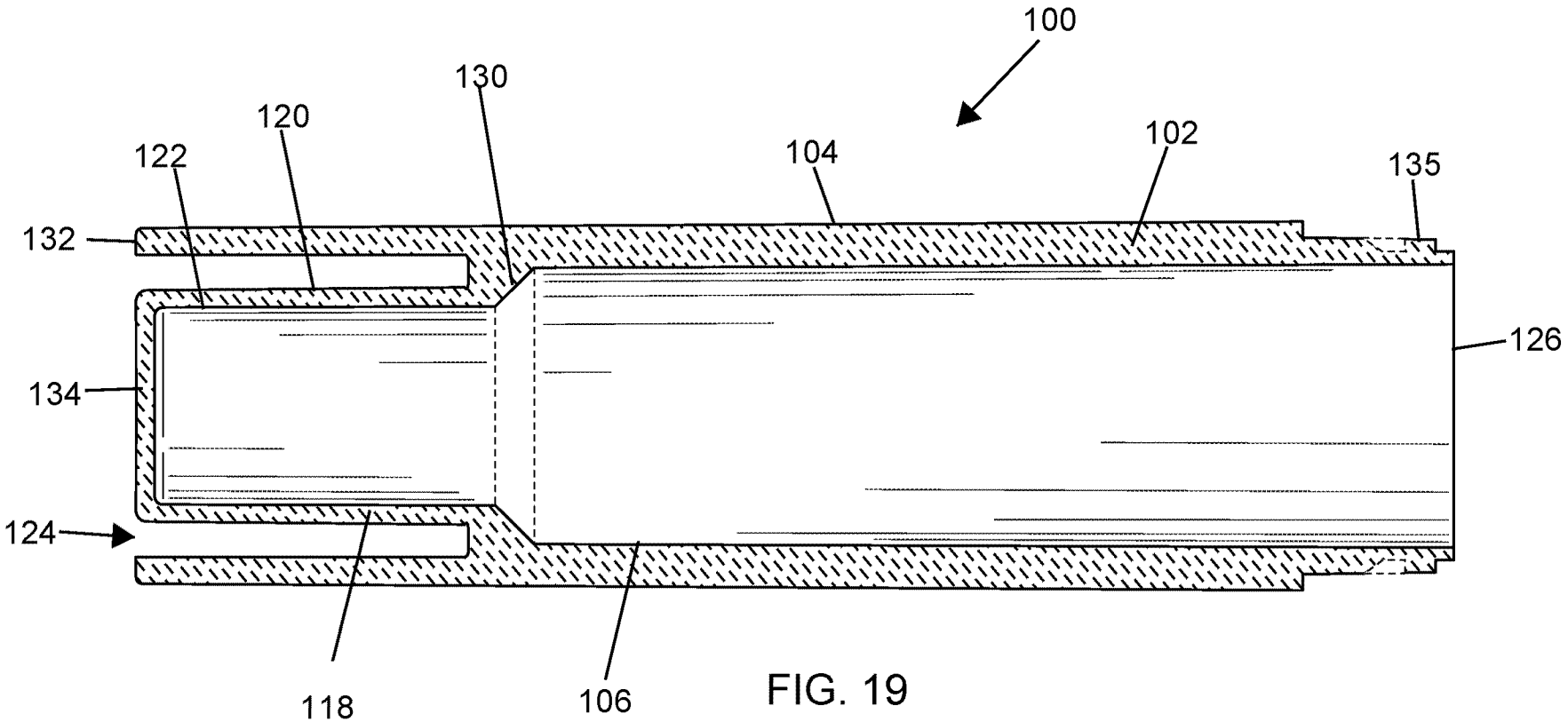
FIGS. 19 and 20 are cross-sectional views of the cartridge tube taken along line 17-17 of FIG. 17 according to an exemplary embodiment of the present disclosure.
Figure 20:
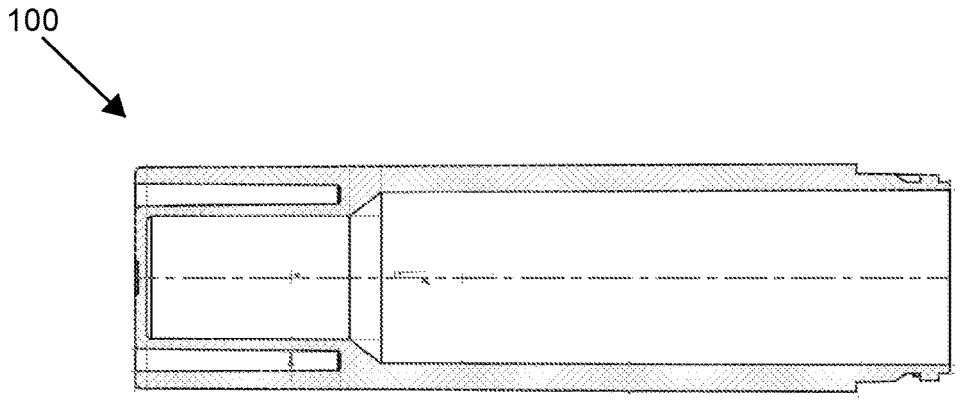
Figure 21:
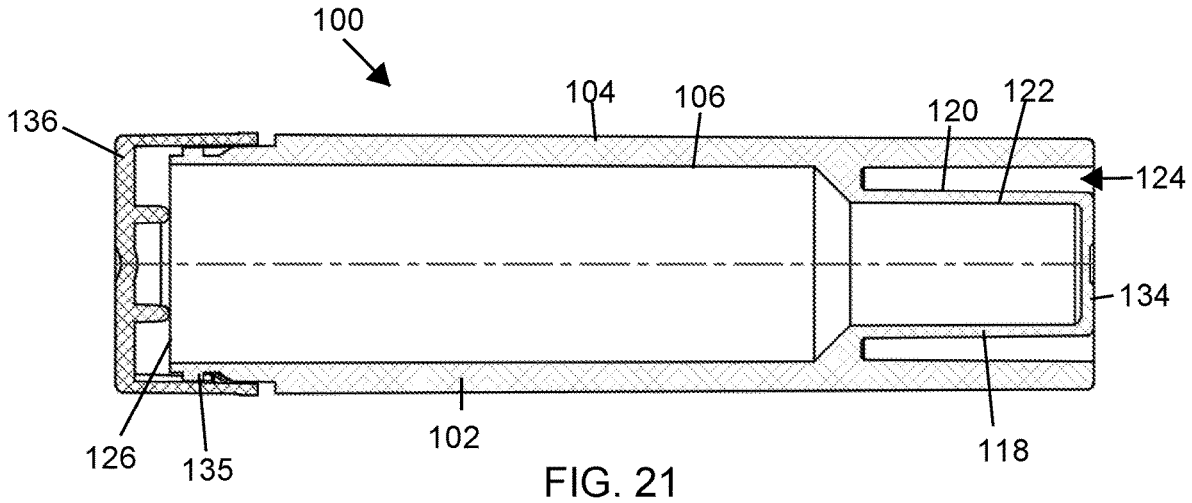
FIG. 21 is a longitudinal cross-sectional view of the cartridge tube with an end cap fixed thereto according to an exemplary embodiment of the present disclosure.

The diameter of the first tube 102 is designed such that the outer surface 104 of the tube 102 is symmetrical with the outer edge of the closure 136 that will be attached thereto. The funnel portion 130 of the first tube 102 is configured to aid in guiding a product in to the inner surface 122 of the second tube 108. The angle of the funnel portion 130 is configured so that it is steep enough to guide a product (e.g., cartridge) into the second tube 108, but not so steep that funnel portion 30 lessens the structural rigidity of the tube 100. For example, as shown in FIG. 19, the funnel portion 130 extends at an obtuse angle with respect to the inner surface 106 of the first tube 102 in cross-sectional view. The length of the second tube 108 is designed to accommodate most known cartridges, but the length of the tube 108 not so long that shorter cartridges would be damaged in transport by escaping the second tube 108. The channel gap 124 at the distal end of the tube 100, between the first sidewall 102 and second sidewall 108 is designed to speed up the manufacturing process as the air gap allows for a reduced cooling times. As shown in FIG. 19, the gap 124 may extend inwardly from the second end 128 along at least a portion of the length of the second tube 108. In addition, the gap 124 may extend all-around the outer surface 120 of the second tube 108 in order to encircle the second tube 108 concentrically. The diameter of the inner tube 108 is set just large enough to accommodate cartridges, but not too large to allow excess rattle. The length of the inner tube 108 is set to hold a cartridge in an upright position for display as well as for protection during transport.

In an embodiment, for both tubes 10, 100, the overall length thereof is about 80 mm with the stepped region of the first tube being about 9 mm and the outer diameter is about 22 mm. The internal diameter of the first tube 102 is about 16.3 mm and the internal diameter of the second tube 108 is about 12 mm, the external diameter of the second tube 108 is about 14 mm.

Although the description above and accompanying drawings contains much specificity, the details provided should not be construed as limiting the scope of the embodiments, but merely as describing some of the features of the embodiments. The description and figures should not to be taken as restrictive and are understood as broad and general teachings in accordance with the present invention. While the embodiments have been described using specific terms, such description is for illustrative purposes only, and it is to be understood that modifications and variations to such embodiments, including, but not limited to, the substitutions of equivalent features and terminology may be readily apparent to those of skill in the art based upon this disclosure without departing from the spirit and scope of the invention.

What is claimed is:

1. A cartridge tube, comprising:

a first tube including a sidewall having an outer surface and an inner surface extending between a first end and a second end, the second end being delimited by a first end wall that extends along a first plane; and a second tube including a sidewall having an outer surface and an inner surface extending between a first end and a second end thereof, the second end being delimited by a second end wall that has an outer surface that extends along the first plane and an inner surface that extends linearly along a second plane that is spaced from the first plane with an outer diameter of the sidewall of the second tube being less than an inner diameter of the sidewall of the first tube, the outer surface of the sidewall of the second tube being spaced from the inner surface of the sidewall of the first tube such that a gap exists between the inner surface of the sidewall of the first tube and the outer surface of the sidewall of the second tube and the gap encircles the sidewall of the second tube and the inner surface of the first tube and the gap is open to an external environment at a distal end thereof;

a segment of the inner surface of the first tube transitioning to the inner surface of the second tube at an inclined portion of the inner surface of the first tube to aid in positioning a product within the second tube and the outer surface of the first tube at the first end including at least one locking mechanism extending therefrom; and a covering configured to extend over the first end of the tube and interact with the at least one locking mechanism to releasably seal the first end of the first tube.

2. The cartridge tube of claim 1, wherein the at least one locking mechanism is a plurality of locking mechanisms, the outer surface of first tube includes a stepped region extending from the first end thereof toward the second end and the plurality of locking mechanisms extend from the stepped region.

3. The cartridge tube of claim 1, wherein the first tube is longer than the second tube.

4. The cartridge tube of claim 2, wherein the closure is configured to extend over the stepped region of the outer surface and interact with the plurality of locking mechanisms to releasably seal the cartridge tube.

5. The cartridge tube of claim 1, wherein the first tube and the second tube are each comprised of one of a transparent and translucent material.

6. The cartridge tube of claim 1, wherein the gap extends from the second end of the second tube in a direction toward the first end of the second tube.

* * * * *